US007178458B1

(12) United States Patent
Bates

(10) Patent No.: US 7,178,458 B1
(45) Date of Patent: Feb. 20, 2007

(54) METHOD OF MAKING TRANSFER PRINTED WEBBING

(76) Inventor: Thomas P Bates, 54 Main St., East Haddam, CT (US) 06423

( * ) Notice: Subject to any disclaimer, the term of this patent is extended or adjusted under 35 U.S.C. 154(b) by 938 days.

(21) Appl. No.: 10/196,067

(22) Filed: Jul. 15, 2002

(51) Int. Cl.
*B41C 1/06* (2006.01)

(52) U.S. Cl. ..... 101/34; 101/33; 101/178; 101/485; 101/226; 101/481; 400/621.1; 83/13; 83/78

(58) Field of Classification Search ..... 101/34, 101/33, 178, 485, 481; 400/621.1, 630; 83/13, 83/78
See application file for complete search history.

(56) References Cited

U.S. PATENT DOCUMENTS 3,556,509 A * 1/1971 Crum ..... 270/52.08
3,709,081 A * 1/1973 Rush ..... 83/444
3,958,051 A * 5/1976 Smith ..... 428/42.3
4,570,518 A * 2/1986 Burmeister et al. ..... 83/504
4,883,688 A * 11/1989 Houts et al. ..... 427/285
5,160,505 A * 11/1992 Seveno et al. ..... 8/471
5,474,248 A * 12/1995 Bradshaw et al. ..... 242/421.8
5,815,186 A * 9/1998 Lewis et al. ..... 347/101
6,166,366 A * 12/2000 Lewis et al. ..... 250/208.1
6,267,034 B1 * 7/2001 Beckwith ..... 83/305
6,419,218 B1 * 7/2002 Hartsoe et al. ..... 270/52.17
2005/0217447 A1 * 10/2005 Hollandsworth et al. ..... 83/499

* cited by examiner

*Primary Examiner*—Judy Nguyen
*Assistant Examiner*—Matthew Marini
(74) *Attorney, Agent, or Firm*—DeLio & Peterson, LLC

(57) ABSTRACT

A method of economically dye transfer printing small batches of webbing with custom designs includes printing N longitudinally adjacent identical design strips of approximate length L/N with a desired custom design. The design is printed on continuous roll paper with dye transfer ink using a dye transfer printer controlled by a personal computer. The adjacent design strips are simultaneously cut apart using a slitting cutter with parallel disc blades. The slitting cutter is preferably a modified leather slitting cutter with variable speed control and additional alignment guides for precise cutting. The separated design strips of approximate length L/N are assembled into a continuous transfer strip of approximate length L and rolled onto a core. The transfer strip is fed through an aligner with blank webbing and into a heat transfer web rolling machine where heat and pressure are applied to transfer print the design from the transfer strip to the webbing and produce final printed webbing of length L.

18 Claims, 6 Drawing Sheets

METHOD OF MAKING TRANSFER PRINTED WEBBING

BACKGROUND OF THE INVENTION

1. Field of the Invention

This invention relates to the manufacture of webbing printed with graphics or text. More specifically, this invention relates to a method of making such webbing using transfer printing techniques that is economical and rapid even when making many short lengths of webbing with different custom designs.

2. Description of Related Art

There are many uses for narrow fabric webbing that displays graphic designs, text and/or logos, such as carrying straps, belts, suspenders and harnesses. Such decorative webbing is widely used to indicate association of a product incorporating the webbing with a group or recreational activity. Webbing may be used to promote a sports team or public event, to identify the product manufacturer and for other forms of advertising.

One method of making this type of webbing is to weave the desired design directly into the webbing using specialized pattern weaving looms and colored threads. This method is expensive and is limited in the resolution of the text and images that can be produced, as well as in the number of colors that can be incorporated into the design. It takes a relatively long time to set up the loom for production using this method and is, consequently, suitable only for relatively high volume production runs.

A second method is to stitch the design with colored thread into blank webbing. This is an expensive method for both small and large volume production and is still limited in the number of colors that can be used and in the resolution of the images that can be produced.

Yet another method of producing decorative webbing is to directly or indirectly print the design or text on the webbing. In direct printing, the webbing is fed into the printer where the design is printed with webbing compatible inks. In the indirect process the design is printed on transfer paper and is then transferred to the webbing, usually by heating. In conventional implementations of these methods, the printing is done with presses that require printing plates and extensive setup. While these prior art printing methods allow a much wider variety of colors and higher resolution, they are suitable only for relatively high volume production runs where the initial setup costs can be spread over the high volume output.

When conventional printing methods are used to produce the webbing designs, only a limited number of different popular designs can be carried due to the requirement for large production runs for each design. Large inventories become prohibitively expensive. A webbing manufacturer is generally unwilling to make specialized designs unless the customer places a large order. Small orders for short lengths of custom designed decorative webbing of the type that would be used to promote a local public event cannot be produced profitably using these older techniques.

Bearing in mind the problems and deficiencies of the prior art, it is therefore an object of the present invention to provide a method of making transfer printed webbing that is suitable for small production runs of custom designed graphics and text having numerous colors and high resolution.

Still other objects and advantages of the invention will in part be obvious and will in part be apparent from the specification.

SUMMARY OF THE INVENTION

The above and other objects, which will be apparent to those skilled in art, are achieved in the present invention which is directed to a method of making transfer printed webbing in which a computer controlled, roll paper fed, dye transfer printer is used to print a first plurality of longitudinally adjacent designs on continuous roll paper with dye transfer ink. A slitting cutter having a plurality of spaced-apart cutting blades simultaneously cuts apart the first plurality of longitudinally adjacent designs and thereby produces a first plurality of design strips.

The design strips are assembled to form a continuous transfer strip. Blank webbing and the transfer strip are fed into an aligner, which transversely aligns the transfer strip with the webbing. The aligned webbing and transfer strip are simultaneously fed into a heat transfer web rolling machine to transfer print the webbing with the first plurality of designs.

The slitting cutter preferably includes disc blades, a speed control, an edge alignment guide and an overlying transparent guide with alignment marks having a spacing corresponding to the spaced-apart cutting blades. The speed control preferably allows operation at a speed of less than 200 centimeters per minute and, more preferably, at a speed of less than 75 centimeters per minute, depending on operator skill. The slitting cutter may be a modified leather slitting cutter.

The webbing to be transfer printed is preferably provided with dark or black edges that do not show the transfer ink and a light color or white interior portion that easily shows the transfer ink.

The aligner preferably can simultaneously transversely align parallel first and second transfer strips with corresponding lengths of webbing. When parallel transfer strips are to be printed, the heat transfer web rolling machine is wide enough to simultaneously receive the first and second transfer strips and simultaneously heat them.

In the most highly preferred implementation of the method, the transfer strip is wound onto a core after the design strips are assembled into the transfer strip. During the step of assembling the design strips it is preferable to overlap the design strips in a preferred direction to allow the transfer strip to smoothly feed though the aligner without catching on projections.

The step of printing longitudinally adjacent designs preferably includes printing N longitudinally adjacent designs of a length approximately equal to L divided by N, where "L" is a desired final length of transfer printed webbing. The number of adjacent design strips 'N' is typically greater than or equal to four.

Multiple transfer strips may be transferred to webbing either sequentially, by feeding them sequentially through the aligner, or simultaneously, by feeding them in parallel through the aligner.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1 shows a computer and a dye transfer printer for printing on roll paper with dye transfer inks. In a first step, designs are prepared on the computer, and are then printed on the roll paper as longitudinally adjacent designs.

FIGS. 2 through 4 show a slitting cutter and the next step of the method wherein the longitudinally adjacent designs on the roll paper are simultaneously cut apart by the slitting cutter to produce individual separated design strips.

FIG. 2 provides a side elevational view of the slitting cutter suitable for use in this step of the method. The slitting cutter includes multiple spaced-apart cutting blades, preferably disc blades, for simultaneously slitting a wide input material into narrower output strips.

FIG. 3 provides a front elevational view of the slitting cutter shown in FIG. 2 showing the roll paper with longitudinally adjacent designs being fed into the slitting cutter in alignment with the cutting blades.

FIG. 4 provides a perspective view of the slitting cutter in FIG. 2 showing the roll paper printed with longitudinally adjacent designs being fed into the slitting cutter and being simultaneously cut apart into multiple separate design strips.

FIG. 5 illustrates how design strips are assembled after they are cut apart by the slitting cutter into a continuous and longer transfer strip.

FIG. 6 shows a winder and the step of winding the transfer strip onto a core.

FIG. 7 provides a detailed view showing a preferred blank webbing material with dark or black edges prior to being transfer printed with the design on the transfer strip.

FIG. 8 shows an aligner and the step of simultaneously feeding the webbing and the transfer strip through the aligner, such that the lateral edges of the transfer strip are aligned with the edges of the blank webbing and the surface of the transfer strip containing the dye transfer ink printed designs is positioned in face-to-face contact with the surface of the blank webbing to be transfer printed with the design.

FIG. 9 shows a heat transfer web rolling machine and the step of feeding the aligned transfer strip and blank webbing into the heat transfer web rolling machine to transfer print the webbing with the designs on the transfer strip.

DESCRIPTION OF THE PREFERRED EMBODIMENT(S)

In describing the preferred embodiment of the present invention, reference will be made herein to FIGS. 1–9 of the drawings in which like numerals refer to like features of the invention.

Figure 1:
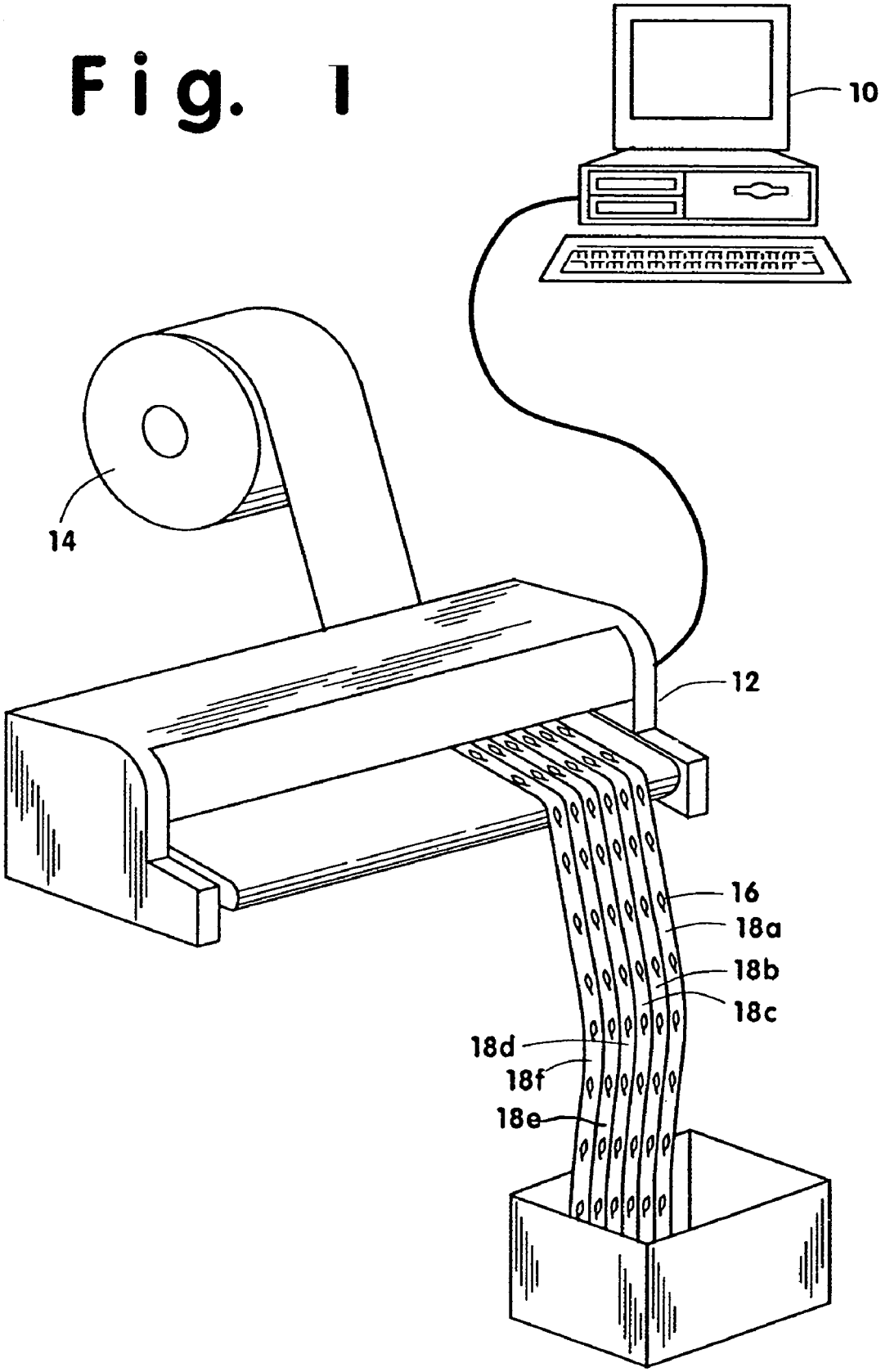
FIGS. 1 through 9 show apparatus and materials used and details of the steps in the method of making transfer printed webbing according to the present invention.

Referring to FIG. 1, the method of the present invention begins by preparing a desired design comprising graphics and/or text on a personal computer 10 and printing the design using a computer controlled, roll paper fed, dye transfer printer 12. A suitable dye transfer printer is capable of applying dye transfer ink at any desired location on the printing surface of roll paper under the control of the computer.

Printers of this type are similar to available personal computer printers and may be used to inexpensively produce an extremely wide variety of customized designs with text and digitized graphic elements. Such printers are ideally suited for short runs of different designs and do not need expensive printing plates or setup for each different design. Suitable printers are preferably ink jet printers sold for dye transfer printing applications, however, thermal transfer printers, dye sublimation printers, laser printers and other available technology computer controlled printers may be used provided they are capable of transferring dye transfer ink to a roll of transfer paper 14. Text and graphics, including digital photographs, scanned images and the like may be incorporated into each design using conventional computer graphics techniques and programs.

The design selected for printing emerges from printer 12 with the design 16 reproduced in dye transfer ink as multiple longitudinally adjacent design strips 18*a* through 18*f*. Each design strip includes multiple copies of the selected design 16, which repeat along the length of each design strip. The width of each individual design strip approximately corresponds to the width of the blank webbing to be transfer printed with the design. The width may be slightly wider to ensure coverage in the event of misalignment or slightly narrower where the blank webbing is provided with borders.

The length of each design strip is approximately equal to the desired length L of the final printed webbing divided by the number N of longitudinally adjacent design strips. In the embodiment shown, there are six longitudinally adjacent design strips 18*a*–18*f* (N=6) and the length of each is one sixth as long as the desired final length L of webbing. The number of design strips (N) printed for each order can be varied by increasing or decreasing the width of the roll paper 14. If an order is received for 60 meters of a desired design, the design is printed as six longitudinally adjacent 10-meter design strips. The length of each subsequent order will be divided by six and printed as six additional adjacent design strips, each being one-sixth the length of the final webbing.

The number of adjacent design strips is preferably at least four (N=4) and may be as high as 12, 16 or higher. The larger the number N of adjacent design strips printed, the faster the printing is finished. This is because the wide carriage printer shown can print paper that is twice as wide more rapidly than it can print paper that is twice as long. Conversely, however, increasing N requires making more seams to connect the individual design strips of length L/N into a final transfer strip of length L used to make the printed webbing of length L.

Figure 2:
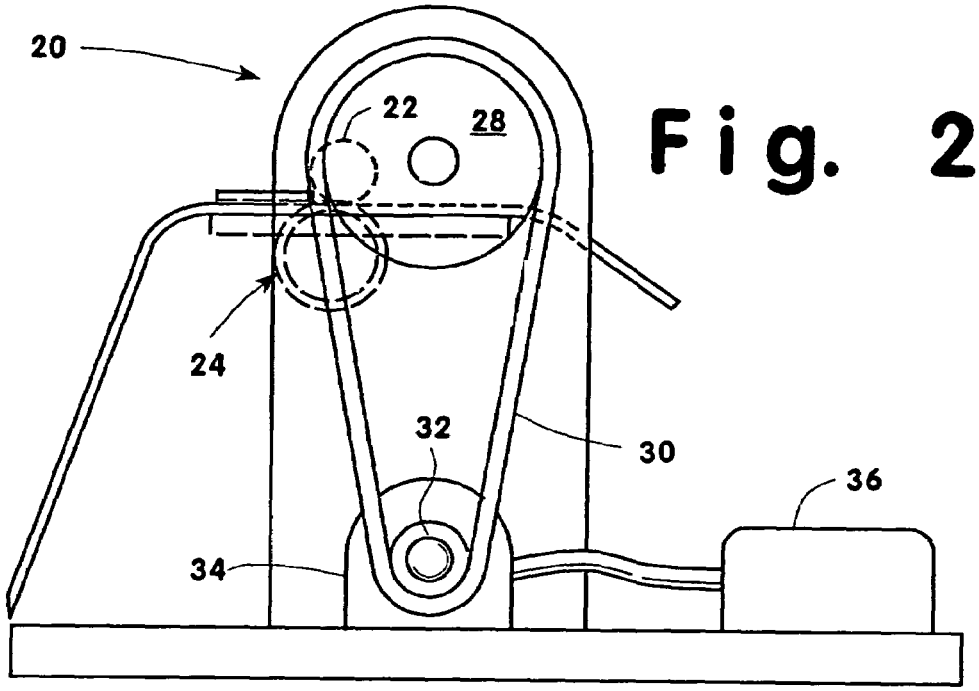
Figure 3:
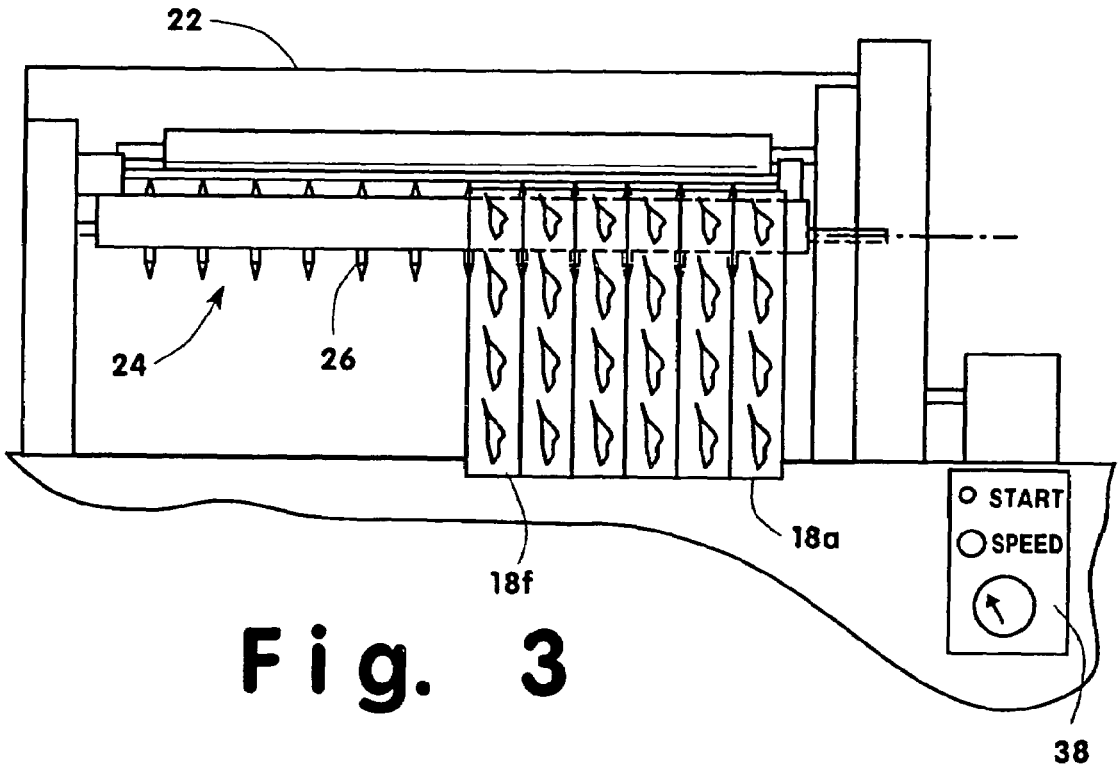
Figure 4:
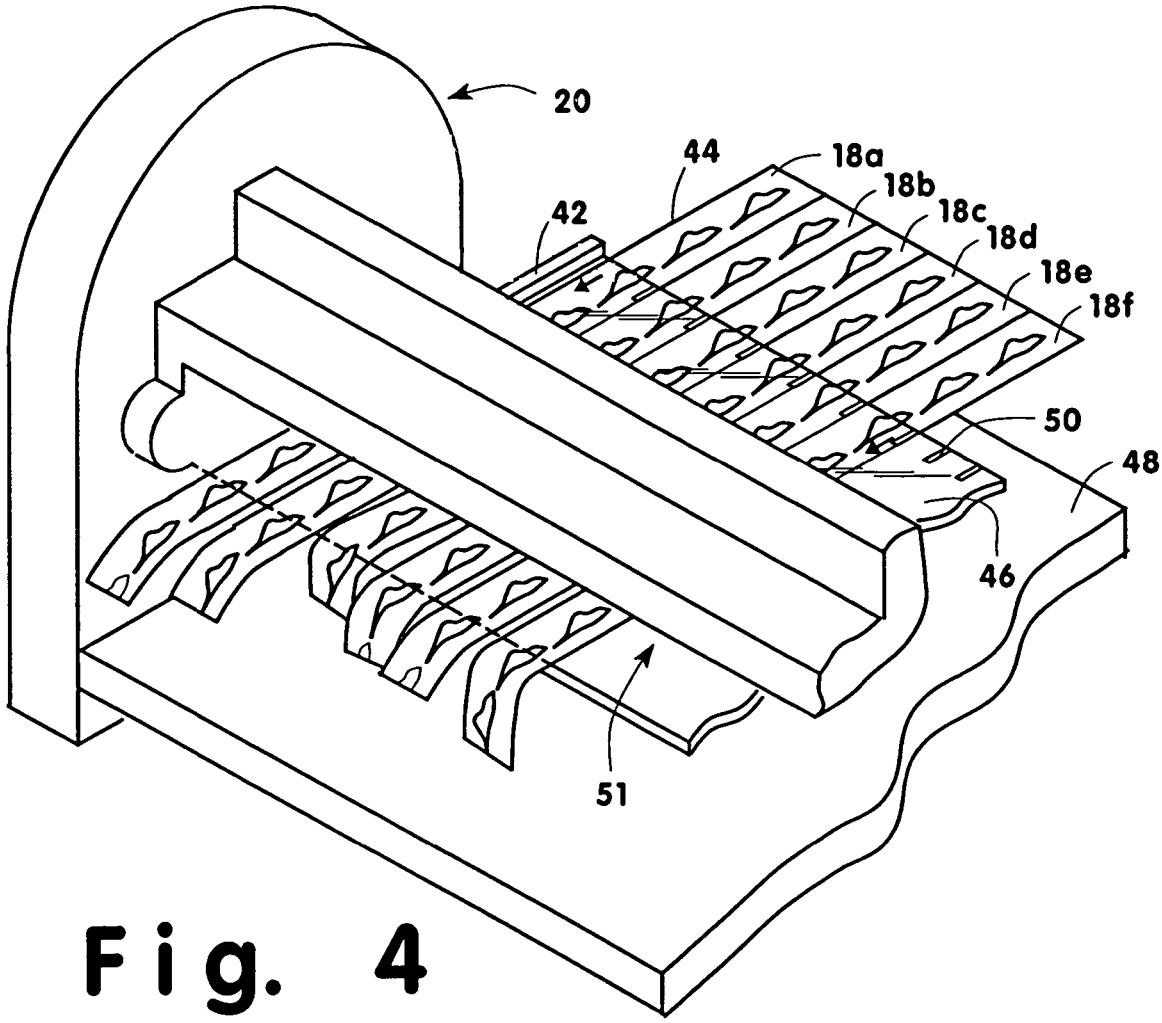

The next step in the method of the present invention is to separate the longitudinally adjacent design strips by passing them through a slitting cutter of the type illustrated in FIGS. 2–4. The slitting cutter uses multiple spaced-apart cutting blades, separated by the width of the design strips, to simultaneously cut apart all the design strips in a single pass through the slitting cutter. Suitable slitting cutters for cutting dye transfer roll paper are not available, however, it is possible to modify available slitting cutters, such as leather slitting cutters, to achieve the desired operation.

A No. 132 round knife parallel slitting machine made by Randall Machinery may be used for this purpose. The Randall Machinery round knife parallel slitting machine is designed to slit wide pieces of leather into multiple narrow strips for use as leather belts and straps. One difficulty with leather slitting machines for use in this application is that they are intended to slit stock material with a substantially uniform surface. In contrast, the slitting required for the present invention must closely follow the separating lines between adjacent design strips. A second problem with leather slitting machines is that they operate at very high slitting speeds. This makes it difficult to control the cutting lines when attempting to cut along separation lines between adjacent design strips.

Accordingly, slitting machines that are presently available must be modified and these modifications are illustrated in FIGS. 2–4. Referring to FIG. 2, the slitting machine 20 includes an upper roller 22 and a lower roller 24. The upper roller 22 is substantially cylindrical and is formed of a plastic, which acts as a cutting surface. The lower roller 24 is composed of multiple disc slitting blades 26. The perimeter of each disc blade 26 is kept extremely sharp and rolls against the plastic cutting surface of upper roller 22. When paper is fed between the upper and lower rollers, it is cut into narrow longitudinal strips determined by the width between the disc blades 26.

The disc blades 26 are separated by the same distance as the width of the design strips. The upper roller 22 and lower roller 24 are geared together so that they turn in opposite directions, thereby ensuring that the upper cutting edges of the disc blades on the lower roller and the lower plastic surface on the upper roller (against which the blades cut) are moving in the same direction at the points of cutting contact. This motion pulls the transfer paper to be cut into the slitting cutter. The two rollers 22, 24 are driven by drive pulley 28, which is turned by belt 30 and motor pulley 32 mounted on motor 34.

In a conventional installation of a leather slitting machine the drive speed of motor 34 is fixed and is significantly higher than is desirable when attempting to make cuts along printed lines of separation. Leather slitters may operate at speeds up to 1200 centimeters per minute, or more, while speeds less than 200 cm/min and preferably closer to 50 or 60 cm/min are more appropriate for accurate cutting of printed design strips. Accordingly, a first modification of the leather slitting machine is to install a motor speed control 36 adjusted with control box 38 (see FIG. 3) so that the operator may select a suitably slow operating speed. The slower speed allows the operator to guide the printed transfer paper into the input of the machine on side 40 (see FIG. 4).

In order to assist the operator in maintaining alignment between the printed design strips and the disc blades, two additional guides are provided. Referring to FIG. 4, the first alignment guide is edge guide 42. The operator holds an edge 44 of the roll paper in contact with edge guide 42 so that the roll paper with the printed design strips enters the slitting cutter in the correct alignment.

To further ensure correct alignment, and to hold the printed transfer paper flat as it enters the machine, an overhead transparent guide plate 46 is installed. The space between the overhead transparent guide plate 46 and the slitting machine table 48 is comparable to the thickness of the transfer paper, which is much less than the thickness of leather.

The transfer paper printed with the design strips is inserted below the overhead transparent guide 46 and slides on the slitting machine table 48. A series of alignment marks 50 are printed on the transparent guide 46 allowing the operator to maintain visual alignment between the design strips and the location at which the slitting blades will make the separating cut.

The slitting cutter is operated at a speed selected according to the skill of the operator and the disc slitting blades simultaneously make all the separating cuts necessary to produce the separated design strips seen emerging from the output 51 of the slitting cutter in FIG. 4. Although the preferred design uses disc blades and a modified leather slitting machine, other slitting cutters, such as multiple knife blades, other types of rotating or moving blades or multiple scissors cutting blades may be used, provided that they are capable of making simultaneous cuts to separate design strips in a single pass through the slitting cutter.

Figure 5:
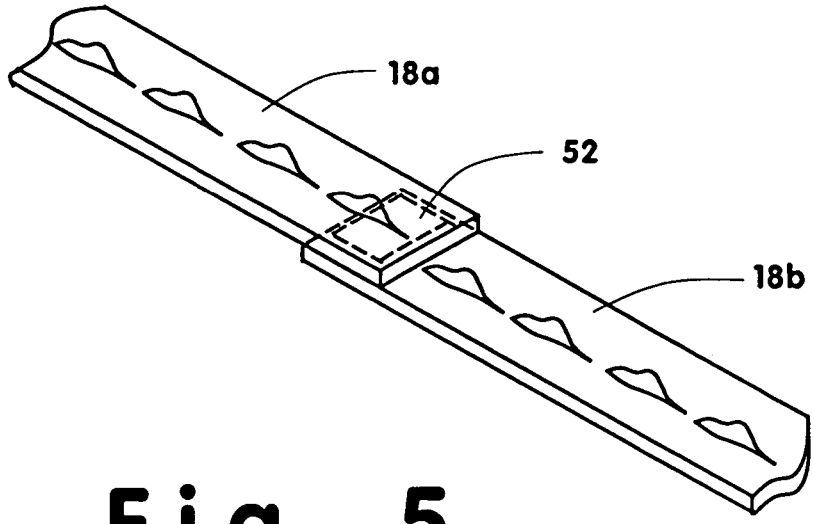

The next step of the method is to assemble the separated design strips into a longer continuous strip referred to as a "transfer strip." The preferred method of assembling the transfer strip is by overlapping the design strips as seen in FIG. 5 and joining them together with double stick adhesive tape 52 beneath the overlapped ends. Alternatively, adhesive or glue may be used in the overlap area or the designs may be cut and connected with a taped butt joint, end to end. As the design strips are overlapped, care is taken to align them transversely and to space them longitudinally so that the strips are matched and the proper spacing between designs is correctly preserved. It may be necessary to trim the design strips at the overlap to ensure correct pattern matching.

Figure 6:
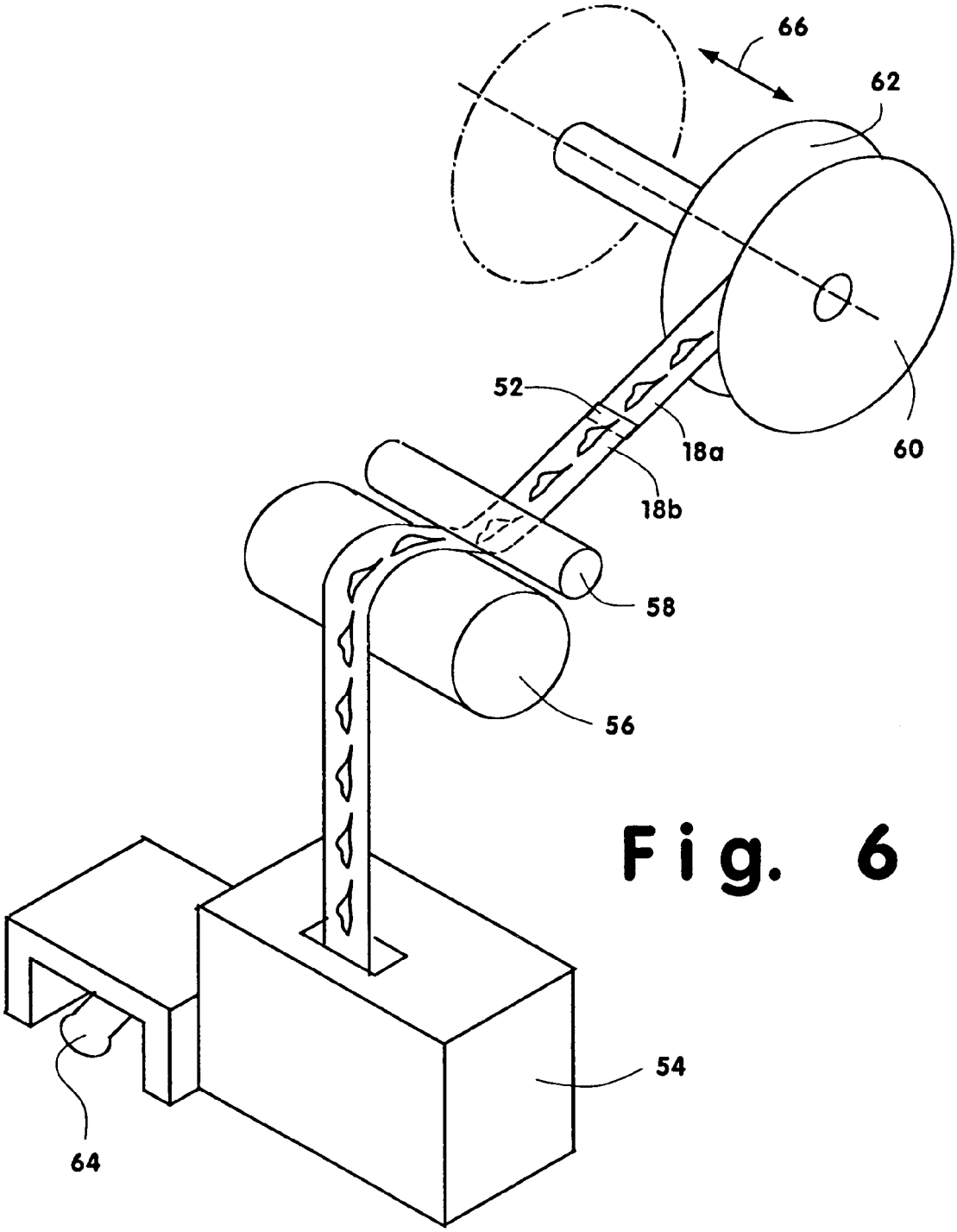

As the design strips are assembled to form the continuous transfer strip, the transfer strip is placed into a supply container 54 (see FIG. 6). After the transfer strip is complete, it is wound onto a paper core using a web rolling machine as illustrated in FIG. 6. The web rolling machine is conventional and is of the type used for rolling ribbon or narrow fabric strips onto a core.

The assembled transfer strip is loosely held in supply container 54 and is threaded between rollers 56 and 58 of the web rolling machine. At least one of the rollers 56, 58 is preferably connected to a counter capable of determining the length of the transfer strip as it is rolled onto the core. This allows the operator to verify that the printed length of the transfer strip is at least as long as the desired final length of the transfer printed webbing to be produced. The end of design strip 18*a* forming the beginning of the transfer strip is attached to the paper core which is held between two discs 60, 62. A winding motor is controlled by foot pedal 64, which allows the operator to control the speed of the winding operation. The winding motor drives disc 60 and the core to wind the transfer strip onto the core. Disc 62 is transversely slidable as indicated by arrow 66 to allow the transfer strip and the core to be removed from the machine and to accommodate different widths of transfer strips.

The transfer strip is wound with the overlapped connection between design strips oriented as shown in FIG. 6. This orientation prevents the overlapped connection from catching on a protrusion or edge as the wound transfer strip is unwound from the core during the final step of transferring the printed design to the webbing. During that final step, any interruption in the supply of the transfer strip would produce errors in the final printed webbing.

Figure 7:
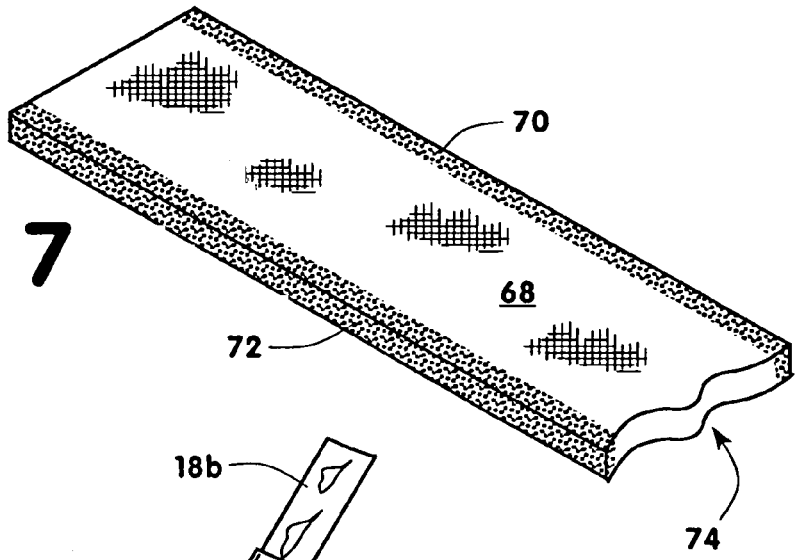

After the transfer strip is wound on the core, the design is ready to be transfer printed onto blank webbing to form the final product. Although the blank webbing may be any color, FIG. 7 illustrates blank woven fabric webbing 74 of the type that is preferred for use with the present invention.

The blank webbing 74 is preferably woven with a white or lightly colored interior portion 68 and two black or very dark portions on the lateral edges 70, 72. The light interior portion 68 is easily printed with any color of transfer ink. The dark edges do not readily show printed transfer ink. Thus the dark edges ensure a nice appearance for the extreme edges of the webbing. Further, any misalignment between the transfer strip and the webbing is relatively non-critical provided that the entire white portion 68 of the webbing is covered with ink. The dark edges produce an attractive transition line at the edges and a professional finished appearance for the webbing.

Figure 8:
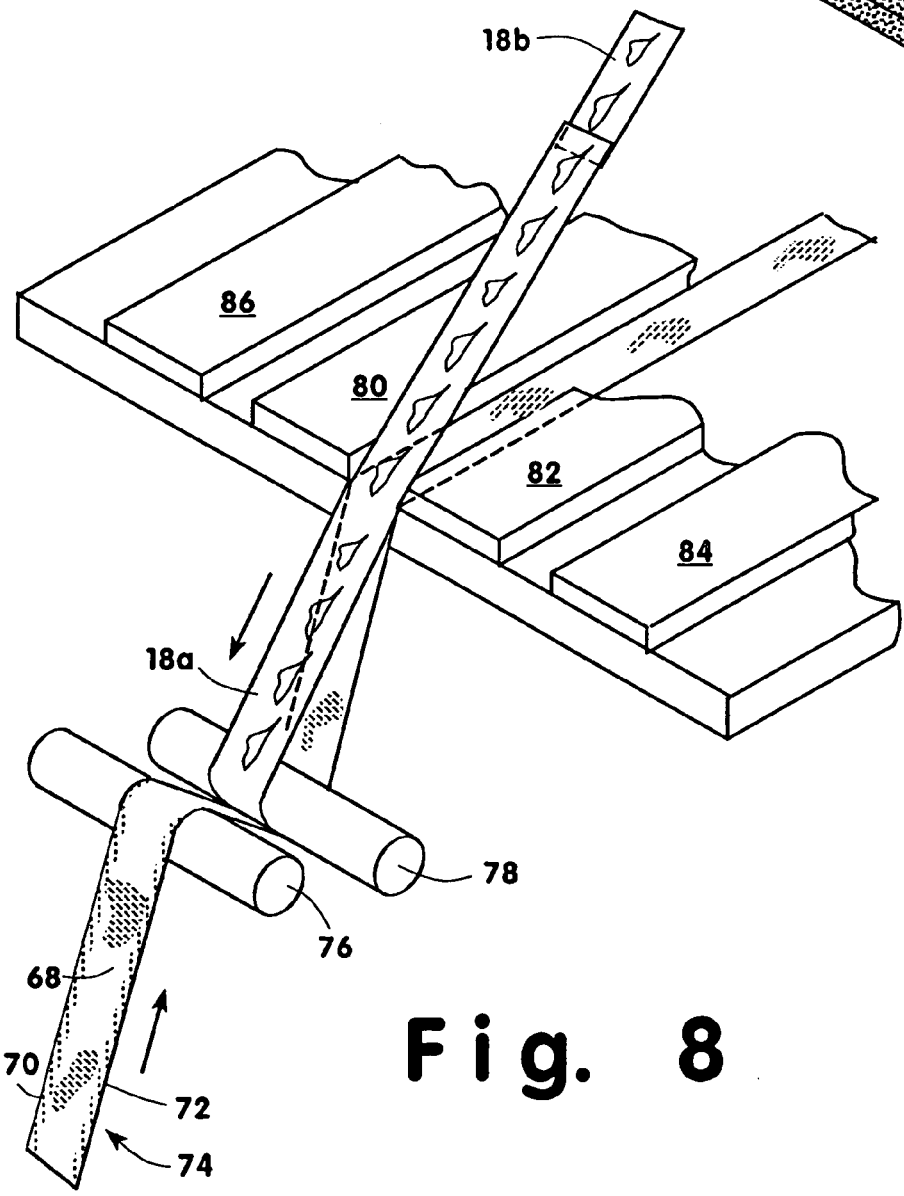

The transfer strip must then be placed in face to face contact with the surface 68 of the webbing to be printed and the edges of the transfer strip must be aligned relative to the edges of the webbing to ensure that the design is printed in the correct transverse location. FIG. 8 illustrates an aligner designed to accomplish this alignment step.

Referring to FIG. 8, the blank webbing 74 is fed from a source of supply over roller 76 where it meets the transfer strip. The transfer strip is fed from the rolled up supply prepared using the web rolling machine in FIG. 6. The blank webbing 74 is fed over roller 76 and under roller 78 such that it remains face up as it passes in between guide strips 80, 82 in the aligner. The transfer strip, however, is fed such that it reverses direction as it passes over, around and under roller 78. This feed path turns the transfer strip face down, so that it is in face-to-face contact with the surface 68 of the webbing 74 to be printed. In this relationship the printed face of the transfer strip directly contacts the surface of the webbing to be printed.

Figure 9:
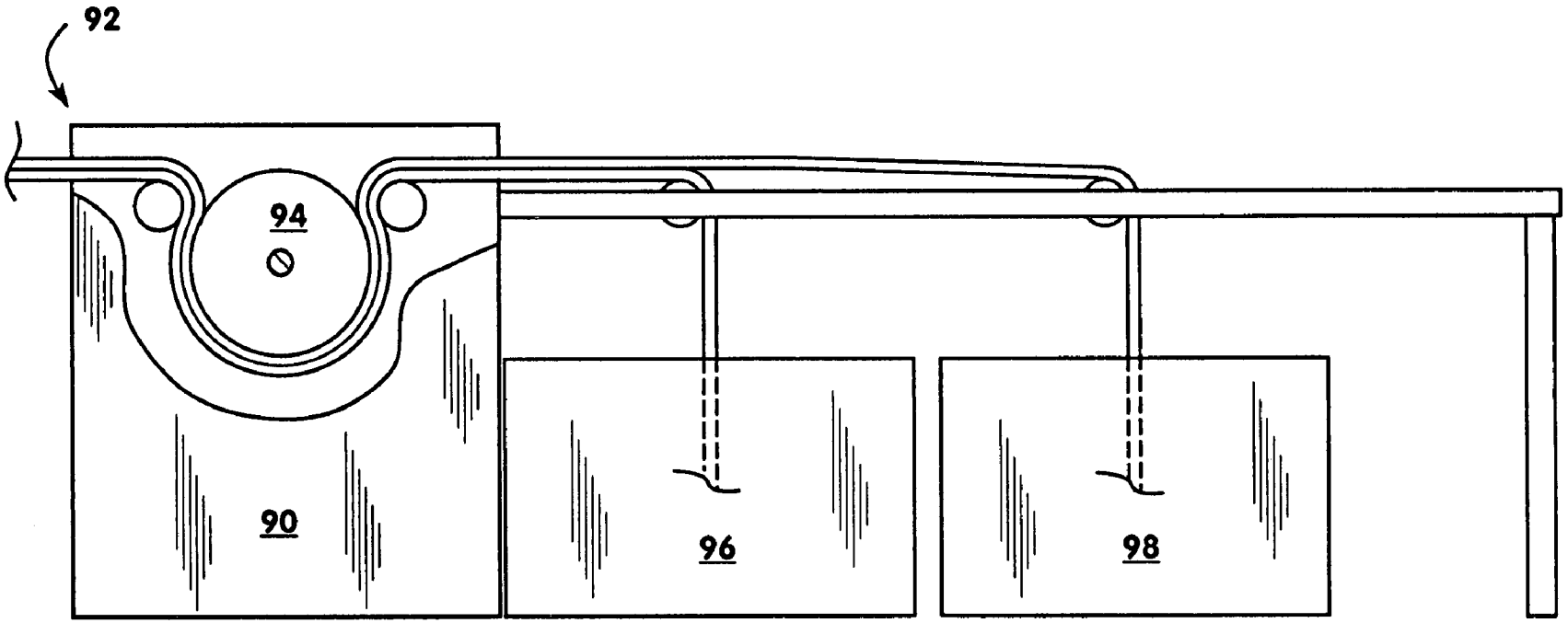

The blank webbing and the transfer strip pass between guide strips 80, 82 of the aligner and enter the heat transfer web rolling machine of FIG. 9 for transfer printing. As can be seen in FIG. 8, the transfer strip is arranged so that it passes between guide strips 80, 82 once as it approaches roller 78 and again after it leaves roller 78. This double contact with the aligner provides additional guidance for the paper strip and further assures the critical transverse alignment.

As can be seen in FIG. 8, there are additional guide strips 84, 86 in the aligner, which allow multiple transfer strips and multiple pieces of webbing to be simultaneously aligned for entry into the heat transfer web rolling machine 90 of FIG. 9. Multiple strips of webbing and multiple transfer strips can be simultaneously aligned and fed in parallel into the heat transfer web rolling machine 90 for simultaneous printing.

Referring to FIG. 9, the aligned webbing and transfer strip leave the aligner, which is preferably mounted near the input 92 of the heat transfer web rolling machine 90. The aligned webbing and transfer strip pass around a drum 94 where heat and pressure are applied. The temperature of the heating process may be varied and the speed of rotation of the drum may be controlled to provide the desired complete transfer of the dye transfer ink from the transfer strip to the webbing 74. There are many manufacturers of suitable heat transfer web rolling machines. One such machine is an Astex 7000 Heat Transfer Rolling Machine made by Astechnologies, Inc. of Roswell Ga.

The finished webbing and the depleted transfer strip exit the heat transfer web rolling machine 90 on the opposite side from the aligner. The finished webbing drops off into collection box 96 and the waste material, comprising the depleted transfer strip, drops off into collection box 98. As described previously, multiple sets of aligned transfer strips and blank webbing may be fed in parallel into the input of the heat transfer web rolling machine and simultaneously printed in parallel.

A transfer strip printed with a second design may be attached to the end of the transfer strip printed with the first design. The connection is preferably made prior to rolling the transfer strips on the core, but it may also be done as the first transfer strip is being fed into the heat transfer web rolling machine. Alternatively, the second transfer strip may simply be fed into the aligner with the blank webbing beyond the first transfer strip after the end of the first transfer strip has passed through. These methods allow the heat transfer step and printing to proceed continuously.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of making transfer printed webbing comprising the steps of:

providing a computer controlled, roll paper fed, dye transfer printer;

printing a first plurality of longitudinally adjacent designs on continuous roll paper with dye transfer ink using the dye transfer printer;

providing a slitting cutter having a plurality of spaced-apart cutting blades for simultaneously slitting a wide input material into a plurality of relatively narrower output strips, the slitting cutter having an operator controlled adjustable speed control allowing adjustment by the operator during cutting to a cutting speed of less than 200 centimeters per minute and an overlying transparent guide plate;

feeding the first plurality of longitudinally adjacent designs into the slitting cutter to simultaneously cut apart the first plurality of longitudinally adjacent designs;

guiding the roll paper during slitting by viewing the longitudinally adjacent designs through the overlying transparent guide plate to produce a first plurality of design strips;

assembling the first plurality of design strips to form a continuous first transfer strip;

providing webbing to be transfer printed with dye transfer ink;

providing an aligner for transversely aligning the first transfer strip and the webbing;

providing a heat transfer web rolling machine for transferring dye transfer ink from the first transfer strip to the webbing;

simultaneously feeding the webbing and the first transfer strip through the aligner, with the dye transfer ink printed designs on the first transfer strip in contact with the webbing; and feeding the aligned first transfer strip and webbing into the heat transfer web rolling machine to transfer print the webbing with the first plurality of designs.

2. The method of making transfer printed webbing according to claim 1 wherein the slitting cutter cuts at a speed of less than 75 centimeters per minute.

3. The method of making transfer printed webbing according to claim 1 wherein the plurality of spaced-apart cutting blades in the slitting cutter are disc blades.

4. The method of making transfer printed webbing according to claim 3 wherein the slitting cutter includes an upper roller and a lower roller rotating in an opposite direction from the upper roller, one of the rollers acting as a cutting surface and the other roller includes the disc blades.

5. The method of making transfer printed webbing according to claim 4 wherein the slitting cutter is a modified leather slitting cutter.

6. The method of making transfer printed webbing according to claim 1 wherein the overlying transparent guide includes alignment marks marked thereon, the alignment marks having a spacing corresponding to the spaced-apart cutting blades.

7. The method of making transfer printed webbing according to claim 1 wherein the slitting cutter includes an edge alignment guide.

8. The method of making transfer printed webbing according to claim 1 wherein the step of providing webbing to be transfer printed comprises providing webbing having dark edges and a light interior portion.

9. The method of making transfer printed webbing according to claim 8 wherein the step of providing webbing to be transfer printed comprises providing webbing having black edges.

10. The method of making transfer printed webbing according to claim 8 wherein the step of providing webbing to be transfer printed comprises providing webbing having a white interior portion.

11. The method of making transfer printed webbing according to claim 8 wherein the step of printing comprises printing the first plurality of longitudinally adjacent designs a transverse distance apart that is at least equal to a width of the light interior portion of the webbing.

12. The method of making transfer printed webbing according to claim 1 wherein the step of providing the aligner comprises providing the aligner for simultaneously transversely aligning the first transfer strip with the webbing and a second parallel transfer strip with a second webbing and wherein the step of providing the heat transfer web rolling machine comprises providing the heat transfer web rolling machine capable of simultaneously receiving the first and second parallel transfer strips for simultaneously transferring printed designs from the first and second transfer strips.

13. The method of making transfer printed webbing according to claim 1 further including the step of winding the first transfer strip onto a core after the step of assembling the first plurality of design strips to form the first transfer strip.

14. The method of making transfer printed webbing according to claim 1 wherein the step of assembling the first plurality of design strips to form the first transfer strip comprises overlapping the design strips in a preferred direction to allow the transfer strip to smoothly feed though the aligner.

15. The method of making transfer printed webbing according to claim 1 wherein the step of printing longitudinally adjacent designs includes printing longitudinally spaced designs on each design strip, the longitudinally spaced designs having a predetermined distance therebetween and wherein the step of assembling the first plurality of design strips to form the first transfer strip includes adjusting longitudinal spacing between the design strips to match the predetermined distance between the longitudinally spaced designs on each design strip.

16. The method of making transfer printed webbing according to claim 1 wherein the step of printing longitudinally adjacent designs includes printing N longitudinally adjacent designs of a length approximately equal to L divided by N where L is a desired final length of transfer printed webbing.

17. The method of making transfer printed webbing according to claim 16 wherein N is greater than or equal to four.

18. The method of making transfer printed webbing according to claim 1 further including the steps of:

printing a second plurality of longitudinally adjacent designs on the continuous roll paper with dye transfer ink using the dye transfer printer;

feeding the second plurality of longitudinally adjacent designs into the slitting cutter to simultaneously cut apart the second plurality of longitudinally adjacent designs and thereby produce a second plurality of design strips;

assembling the second plurality of design strips to form a continuous second transfer strip;

connecting the first transfer strip to the second transfer strip;

feeding the webbing and the second transfer strip through the aligner immediately after the first transfer strip passes through the aligner, with the dye transfer ink printed designs on the second transfer strip in contact with the webbing;

feeding the aligned second transfer strip and webbing into the heat transfer web rolling machine immediately after the first transfer strip passes through the heat transfer web rolling machine to transfer print the webbing with the second plurality of designs; and cutting the webbing to separate the webbing transfer printed with the first plurality of designs from the webbing transfer printed with the second plurality of designs.

* * * * *